US006628494B2

(12) United States Patent
Opfer et al.

(10) Patent No.: US 6,628,494 B2
(45) Date of Patent: Sep. 30, 2003

(54) PROTECTIVE DEVICE AND SYSTEM

(75) Inventors: John C. Opfer, Chicago, IL (US); Henry W. Kowalyshen, Niles, IL (US); Joseph P. Moninski, Arlington Heights, IL (US); Arno J. Tapani, Amherst, NY (US)

(73) Assignee: S&C Electric Co., Chicago, IL (US)

( * ) Notice: Subject to any disclaimer, the term of this patent is extended or adjusted under 35 U.S.C. 154(b) by 135 days.

(21) Appl. No.: 09/793,786

(22) Filed: Feb. 26, 2001

(65) Prior Publication Data

US 2002/0021540 A1 Feb. 21, 2002

Related U.S. Application Data

(60) Provisional application No. 60/186,699, filed on Mar. 3, 2000.

(51) Int. Cl.[7] ..... H01H 73/00

(52) U.S. Cl. ..... 361/115; 361/102; 361/118; 361/117

(58) Field of Search ..... 361/115, 117, 361/118, 102

(56) References Cited

U.S. PATENT DOCUMENTS 5,633,774 A * 5/1997 Robertson et al. ..... 361/93.1
5,854,729 A * 12/1998 Degeneff et al. ..... 361/4

* cited by examiner

*Primary Examiner*—Gregory J. Toatley, Jr.
*Assistant Examiner*—Isabel Rodriguez
(74) *Attorney, Agent, or Firm*—James V. Lapacek

(57) ABSTRACT

A multi-pole protective device and system for electrical power transmission and distribution systems is provided that operates a multi-pole tripping system at ground level from a line-potential tripping device contained within each pole of the multi-pole system. The system includes multiple pole-unit assemblies each of which is totally self-contained and generates a tripping signal in response to overcurrent conditions to operate a ground-potential operating mechanism. In one arrangement, the pole units each include an internal line-potential tripping arrangement that communicates a trip signal to a ground-potential operating mechanism of the pole unit and associated pole units of the protective device arrangement. In a preferred arrangement, the line-potential tripping arrangement includes an insulated member that is moved to transmit the trip signal from line potential to ground potential.

6 Claims, 7 Drawing Sheets

PROTECTIVE DEVICE AND SYSTEM

This application claims the benefit of U.S. Provisional Application No. 60/186,699 filed on Mar. 3, 2000.

BACKGROUND OF THE INVENTION

1. Field of the Invention

The present invention relates generally to the field of protective devices and systems for electrical power transmission and distribution systems, and more particularly to a protective device and system including a pole-unit protective device that provides tripping of interrupters on multiple poles from a line-potential tripping device of each of the pole-unit protective devices.

2. Description of the Related Art

Power transformers and other electrical equipment in the electrical power transmission and distribution field are connected to a power source through various switching and protection devices so as to provide the required desirable protection to the power transformers and electrical devices as well as desirable versatility and flexibility in supplying various load circuits in the electrical power system. For example various fuses, circuit-switchers and circuit breakers are known to provide this protection.

While the prior art arrangements may be useful to provide protective devices with various features, these prior arrangements do not provide desirable protection without extensive demands on space, cost and external controls and associated wiring.

SUMMARY OF THE INVENTION

Accordingly, it is a principal object of the present invention to provide a multi-pole protective device and system for electrical power transmission and distribution systems that operates a multi-pole tripping system at ground level from a line-potential tripping device contained within each pole of the multi-pole system.

It is another object of the present invention to provide a protective arrangement including multiple pole-unit assemblies each of which is responsive to sensed overcurrents to provide a tripping signal to operate the multiple-pole unit assemblies.

It is a further object of the present invention to provide a protective device that is totally self-contained and that generates a tripping signal in response to overcurrent conditions to operate a ground-potential operating mechanism.

It is yet another object of the present invention to provide a protective device arrangement including multiple pole units that each include an internal line-potential tripping arrangement that communicates a trip signal to a ground-potential operating mechanism of the pole unit and associated pole units of the protective device arrangement.

It is a still further object of the present invention to provide a self-contained protective device pole-unit assembly that includes an interrupter, a ground-potential operating mechanism, and a line-potential trip arrangement for sensing overcurrents and operating the ground-potential operating mechanism to open the interrupter.

These and other objects of the present invention are efficiently achieved by the provision of a multi-pole protective device and system for electrical power transmission and distribution systems that operates a multi-pole tripping system at ground level from a line-potential tripping device contained within each pole of the multi-pole system. The system includes multiple pole-unit assemblies each of which is responsive to sensed overcurrents to provide a tripping signal. Each of the pole-unit assemblies is totally self-contained and generates a tripping signal in response to overcurrent conditions to operate a ground-potential operating mechanism. In one arrangement, the pole units each include an internal line-potential tripping arrangement that communicates a trip signal to a ground-potential operating mechanism of the pole unit and associated pole units of the protective device arrangement. Each pole unit also includes an interrupter operated by the ground-potential operating mechanism to open the interrupter. In such an arrangement, the pole units are mechanically independent of each other providing flexibility of location and ease of installation. Thus, the only interconnections between the pole units is the communication of the trip signal via electrical lines or the like. In a preferred arrangement, the line-potential tripping arrangement includes an insulated member that is moved to transmit the trip signal from line potential to ground potential. Also in a preferred arrangement, the movement of the insulated member generates a trip signal to operate the operating mechanism of the pole unit and associated pole units. In an alternate arrangement, the movement of the insulated member controls an electrical circuit to provide tripping signals to the pole units. In a particular arrangement, the operating mechanism of each pole unit is individually recharged manually via a tool affixed to a hot stick or the like. The recharging of the operating mechanism of each pole unit functions to close the interrupter thereof In a particular arrangement, the line-potential tripping arrangement of the pole unit is also reset during the recharging so as to be ready for tripping and operating the pole unit.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
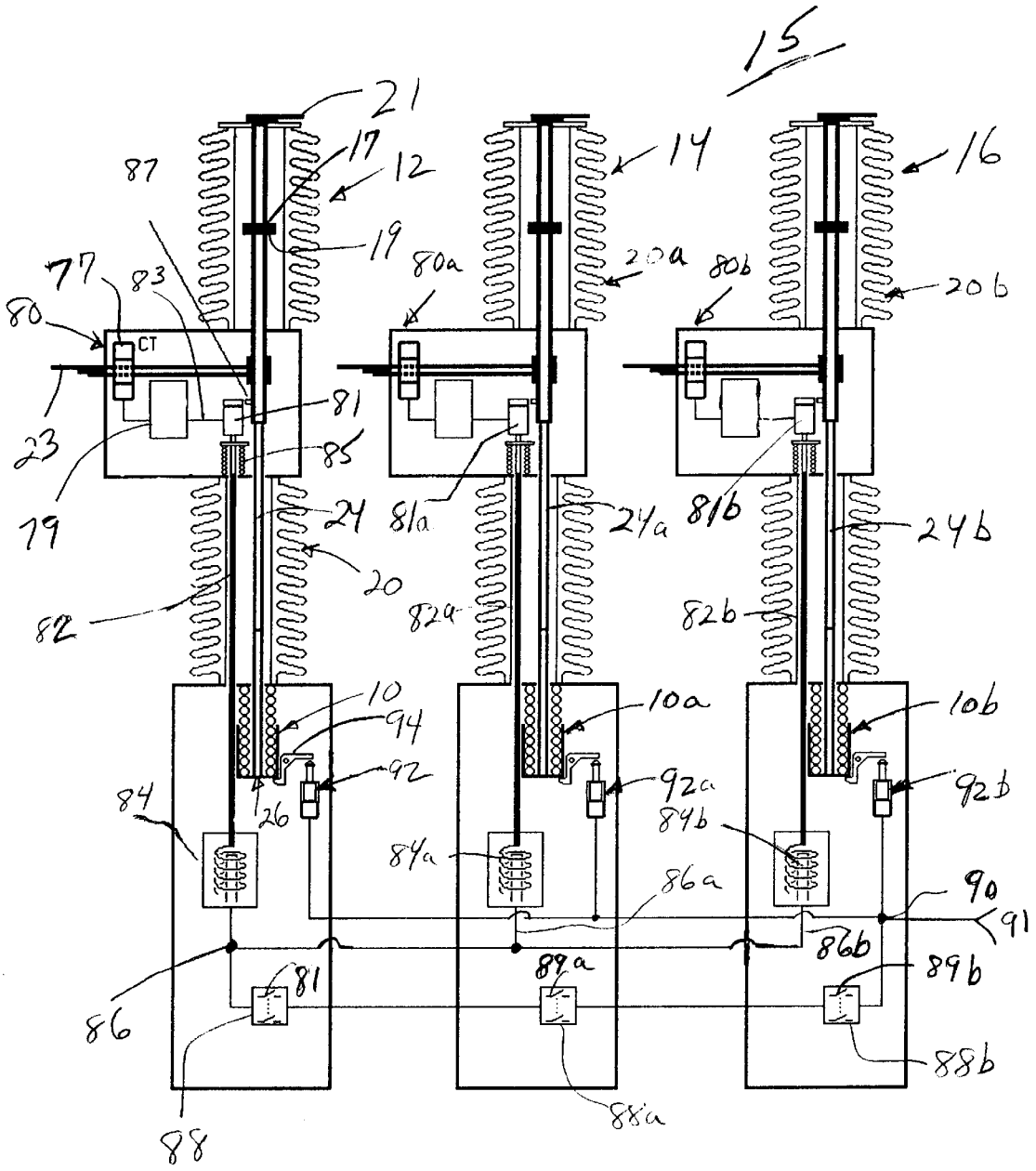
FIG. 1 is a diagrammatic representation of a protective device and system in accordance with the present invention.

Referring now to FIG. 1, a protective system 15 of the present invention includes a plurality of pole units, e.g. 12, 14 and 16 corresponding to a respective pole of a multi-pole electrical power system. Each of the pole units 12, 14 and 16 includes an interrupter 20 having relatively movable contacts 17, 19. The interrupter 20 is operated between open and closed positions by a ground potential operating mechanism 10 via an operating rod 24 that may also be characterized as an operating member. In the closed position, the interrupter 20 electrically connects a first circuit terminal at 21 to a second circuit terminal at 23. In the open position, the interrupter 20 breaks the electrical path between the circuit terminals 21, 23. In operation, the first and second circuit terminals at 21, 23 are energized at various electrical potentials with respect to the ground potential of the operating mechanism 10.

A line-potential tripping arrangement 80, which may also be characterized as a control arrangement, senses current flowing through the interrupter 20 and responds to predetermined overcurrent conditions to provide a trip signal. In a preferred arrangement, the trip signal is communicated via an insulated member 82 located within the interrupter 20 to ground potential in the vicinity of the operating mechanism 10 to operate a signal generator 84. This can also be characterized as communicating, transferring or translating the trip signal via movement of the insulated member 82 to the vicinity of the operating mechanism 10 at ground potential. In a specific embodiment, the line-potential tripping arrangement 80 includes a magnetic latching solenoid device 81 that is pulsed at 83 by a control circuit 79 to release a stored energy device 85 that drives the insulated member 82, e.g. upwardly in FIG. 1. For example, a current-sensing transformer 77 provides a sensed current signal at 78 to a control circuit 79. In response to the movement of the member 82, the signal generator 84 provides an operating signal at 86, e.g. in a specific embodiment, a pulse signal to operate the operating mechanism 10 of the pole unit 12 and the respective operating mechanisms 10*a*, 10*b* of the associated pole units 14, 16. The outputs 86*a*, 86*b* of the signal generators 84*a*, 84*b* of the associated pole units 14, 16 respectively are connected in parallel to each other and to the output 86 of the signal generator 84. In a specific embodiment, the signal generator 84 is a so-called voice-coil generator of the type where a moving coil moves through a magnetic field to produce an output signal. In an arrangement for totally self-contained operation on a single-pole basis, the output 86 is connected directly to a latch tripping device 92 via the signal path 93, tripping a latch at 94 to release the operating mechanism 10 and open the interrupter 20.

In a preferred multi-pole arrangement, the combined output at 86 is connected through the series combination of interlock contacts 88, 88*a* and 88*b* of the pole units 12, 14 and 16 respectively. In order to ensure that the electrical circuits to the interrupters 20 are opened prior to closing the interrupters 20, the interlock contacts 88, 88*a* and 88*b* are each enabled to provide a closed path when a respective disconnect switch 89, 89*a* and 89*b* that is connected in series with the respective electrical paths between the respective terminals 21, 23, 21*a*, 23*a* and 21*b*, 23*b* is open. The output 90 of the interlock switch contacts 88*b* is connected to an input of respective latch tripping devices 92, 92*a* and 92*b* of the respective operating mechanisms 10, 10*a* and 10*b*. For example, in a specific embodiment, the latch tripping devices 92, 92*a* and 92*b* are magnetic latching solenoids that are operated via a pulse signal at 90 to trip a latch at 94, 94*a* and 94*b* to release the respective operating mechanisms 10, 10*a* and 10*b*, opening the respective interrupters 20, 20*a* and 20*b*. In a specific embodiment, the operating mechanism 10 is a stored energy type. The operating mechanism 10 is recharged at 26 for the next opening operation, the interrupter 20 also being closed during the recharging of the operating mechanism 10 via the upward movement of the operating rod 24. In a specific embodiment, the charging input at 26 is provided either via a lifting mechanism or rotation of a manual tool. In one specific embodiment, the line-potential tripping arrangement 80 is also reset during the recharging of the operating mechanism 10 and closing of the interrupter 20. In another specific embodiment, either in addition to or in lieu of the resetting of FIG. 1, the line-potential tripping arrangement 80 is reset during the opening of the interrupter 20 via movement of the operating rod 24, e.g. at 87.

Figure 2:
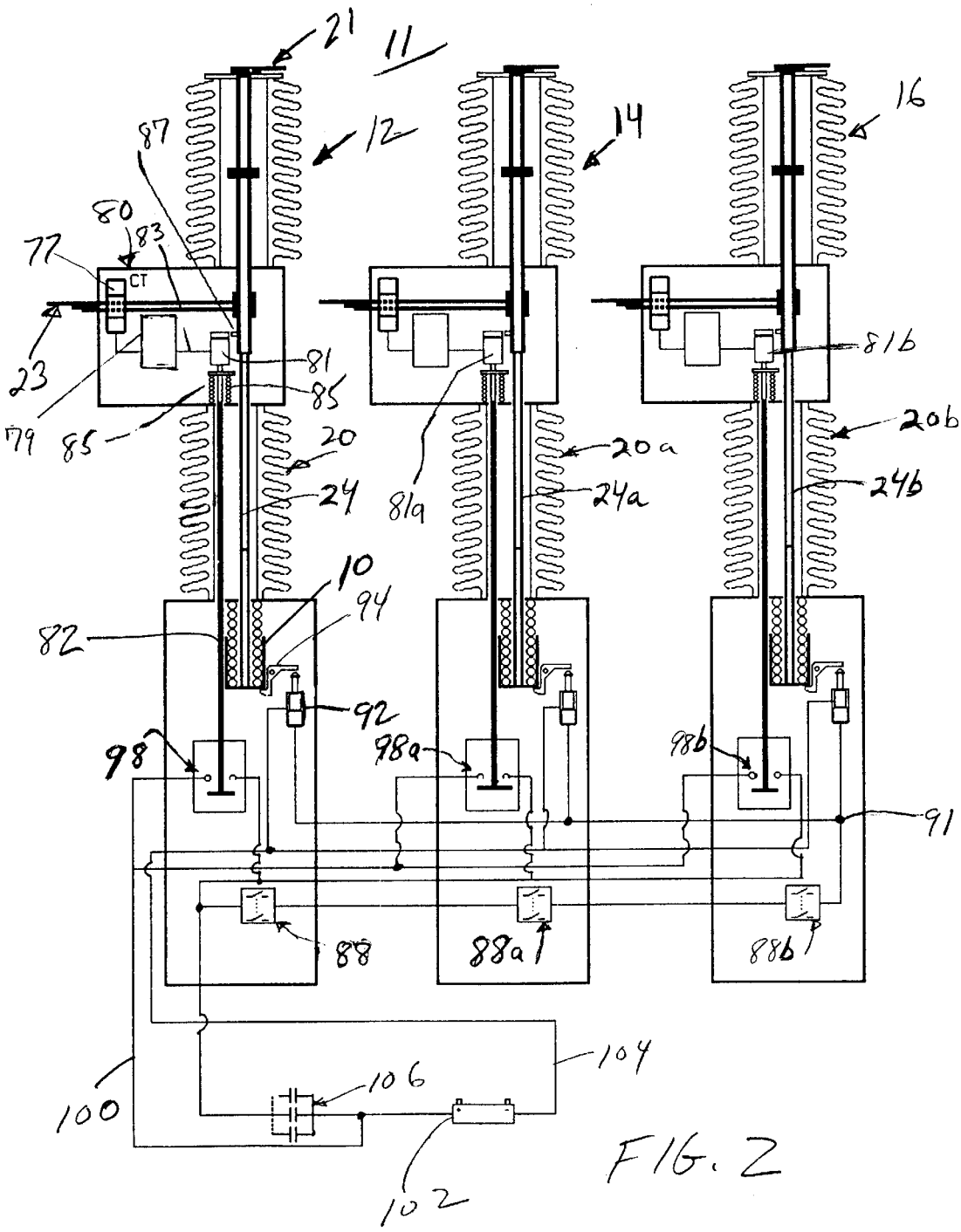
FIG. 2 is a diagrammatic representation of a protective device and system in accordance with an alternate embodiment of the present invention.

Referring now to the arrangement 11 of FIG. 2, upon tripping of any of the line potential tripping arrangements 80, 80*a* or 80*b* and movement of the respective insulating member 82, 82*a* or 82*b*, a respective contact 98, 98*a* or 98*b* is operated to provide electrical continuity with a battery or other power supply 102 via a circuit path 100 to energize the latch tripping devices 92, 92*a* and 92*b* at 91 through the interlock contacts 88, 88*a* and 88*b*. As illustrated in FIG. 2, local operating contacts at 106 are provided to energize the latch tripping devices 92, 92*a* and 92*b*. As noted in FIG. 2, while a power supply 102 is required, the signal generator 84 is not required. However, with reference now to FIGS. 1 and 2, it should be understood that the present invention also includes an arrangement where there is selectively utilized the input signals at 90 in FIG. 1 along with the input signals at 91 in FIG. 2, as noted by reference to the input 91 in FIG. 1.

Figure 3:
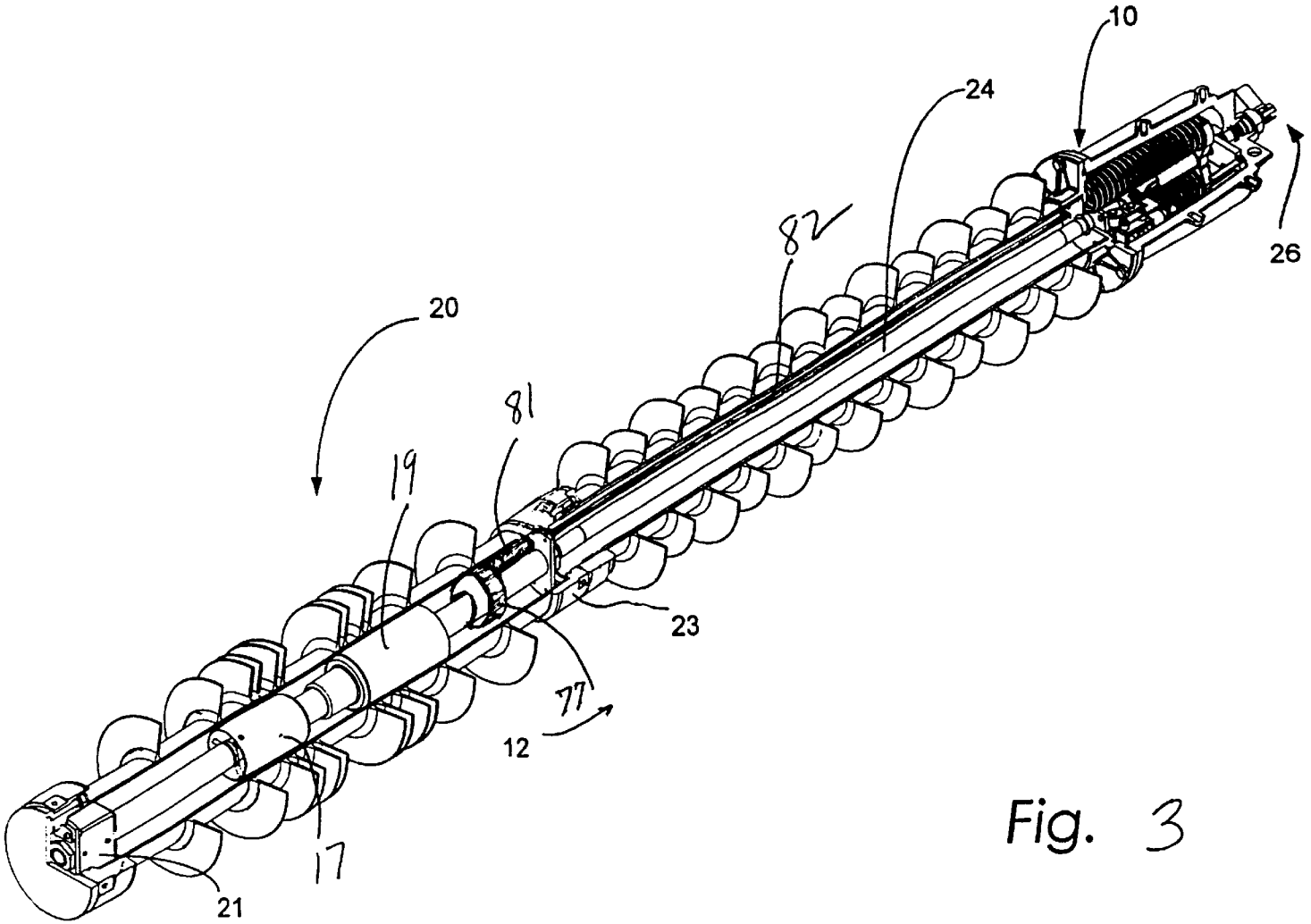
FIGS. 3 and 4 are perspective views, with parts cutaway for clarity, of an illustrative implementation of the protective device of FIGS. 1 and 2.
Figure 4:
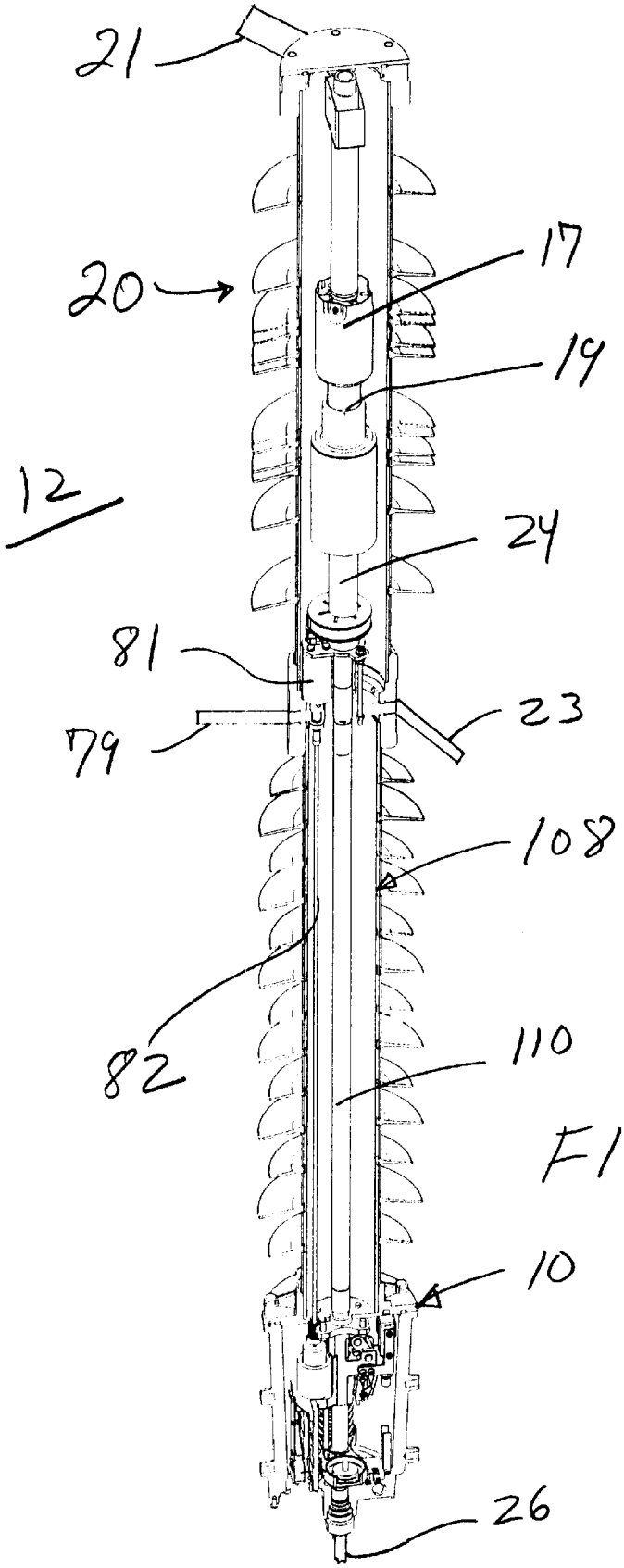

In accordance with additional features of the present invention and referring now to FIGS. 3 and 4, in an illustrative embodiment, the pole unit 12 is generally cylindrical shape overall including a generally cylindrical interrupter 20, a generally cylindrical operating mechanism 10 and an insulating support column 108 intermediate the interrupter 20 and the operating mechanism 10. The insulated member 82 is disposed through the insulating support column 108. The operating member 24 is connected to an operating member 110 that is disposed through the insulating support column 108. Thus, the overall pole unit 12 provides an internal, self-contained tripping system that communicates the trip function via the insulated member 82 to the operating mechanism 10. Since the pole unit 12 is self contained, mounting of the pole unit is convenient and flexible such that only electrical connections are required between the pole units 12, 14 and 16.

Figure 5:
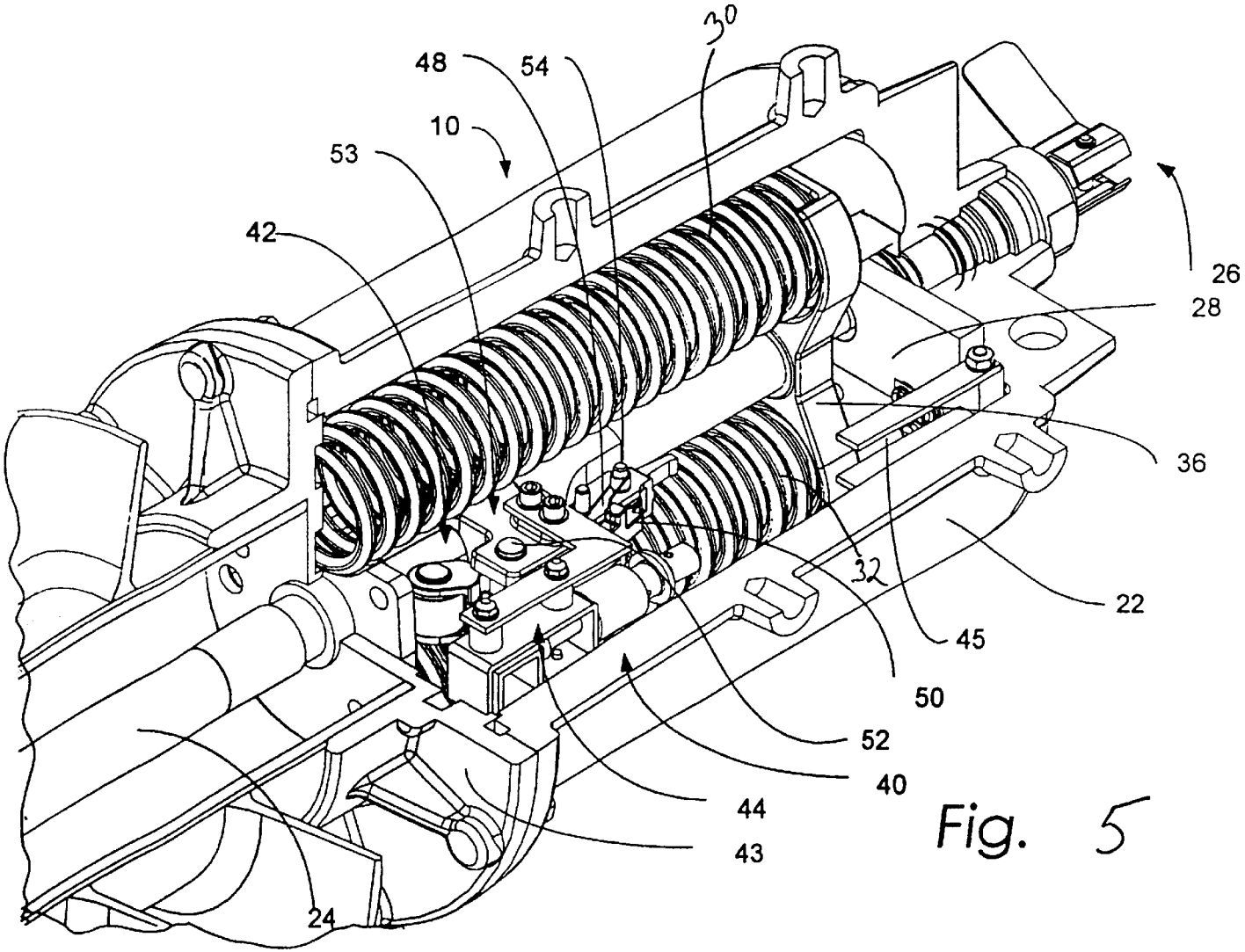
FIG. 5 is a partial perspective view, with parts cut away for clarity, of the protective device of FIGS. 3 and 4 illustrating an operating mechanism thereof.
Figure 6:
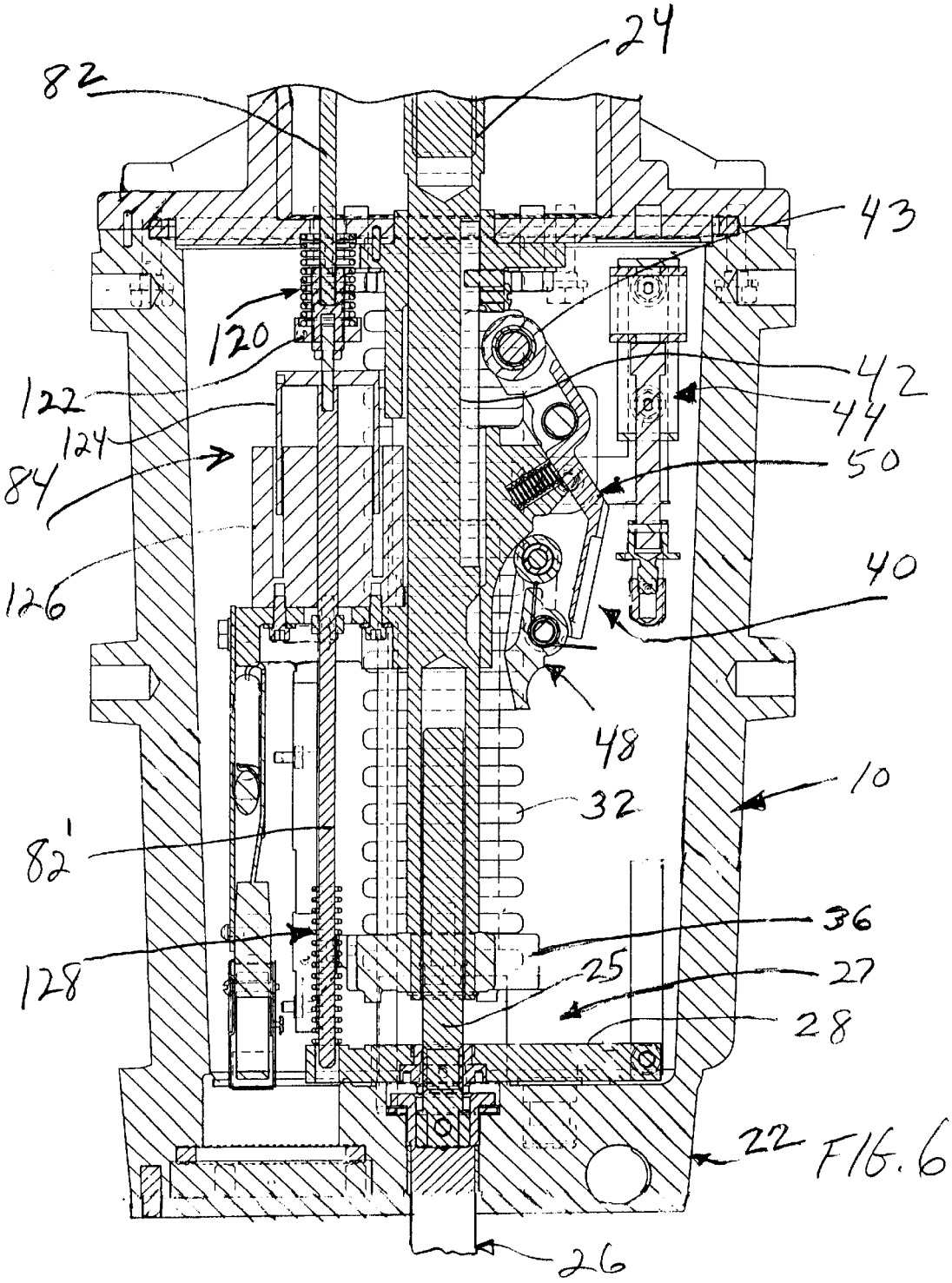
FIG. 6 is a partial sectional view of FIG. 5 taken generally along the line 6-6 of FIG. 5.

Considering additional aspects of the operating mechanism 10 and referring now additionally to FIGS. 5 and 6, the operating mechanism 10 includes a housing 22 that encloses one or more springs 30, 32. The springs 30, 32 act between the housing 22 and a shuttle 36 that may also be characterized as a carrier or carriage. The shuttle 36 is attached to the operating rod 24. The shuttle 36 is moved during charging at 26 to charge the springs 30, 32 and move the operating rod 24 to the closed position of the interrupter 20 as shown in FIGS. 1 and 3. A charging arrangement 27 includes a charging screw 25 (FIG. 6) that is rotated by the charging input 26. The charging screw 25 drives a charging member 28, e.g. a threaded nut, in response to the charging input at 26, the charging member 28 contacting and moving the shuttle 36. When the shuttle 36 and the operating rod 24 reach the closed position, a latch arrangement 40 is set to latch the operating rod 24 in a detent 42 against the stored energy in the springs 30, 32. Thus, with the latch 40 set, the operating mechanism 10 is retained in the charged, closed position with stored energy in the springs 30, 32. The latch arrangement 40 is generally disposed intermediate the springs 30, 32. When the latch arrangement 40 is released, the shuttle 36 and the operating rod 24 move in response to the release of the energy stored in the springs 30, 32 to open the interrupter 20. In the illustrative embodiment, the latch arrangement 40 is released via the operation of a solenoid 44. The solenoid 44 acts against a secondary latch member 48 that holds a primary latch member 50 in the latched position. Upon movement of the secondary latch member 48, the primary latch member 50 is released and releases the operating rod 24 from the detent at 42 via a latch roller member 43. The operating rod 24 then moves to the open position, the open position of the operating rod 24 and the operating mechanism 10 being illustrated in FIG. 2. The operating mechanism 10 is then again ready for charging via the charging input at 26. The housing 22 of the operating mechanism 10 in a preferred embodiment provides a sealed environment containing a gas, e.g. an insulating gas such as $SF_6$. This is advantageous in implementations where the interrupter 20 contains a pressurized gas such as $SF_6$. In a preferred embodiment, the housing 22 is pressurized at the same pressure as the interrupter 20 such that no seals are required between the housing 22 and the circuit interrupter 20. The pressurized housing 22 of the operating mechanism 10 provides a non-corrosive environment for the housed components of the operating mechanism 10 as well as reducing the sealing demands of the interrupter 20.

Figure 7:
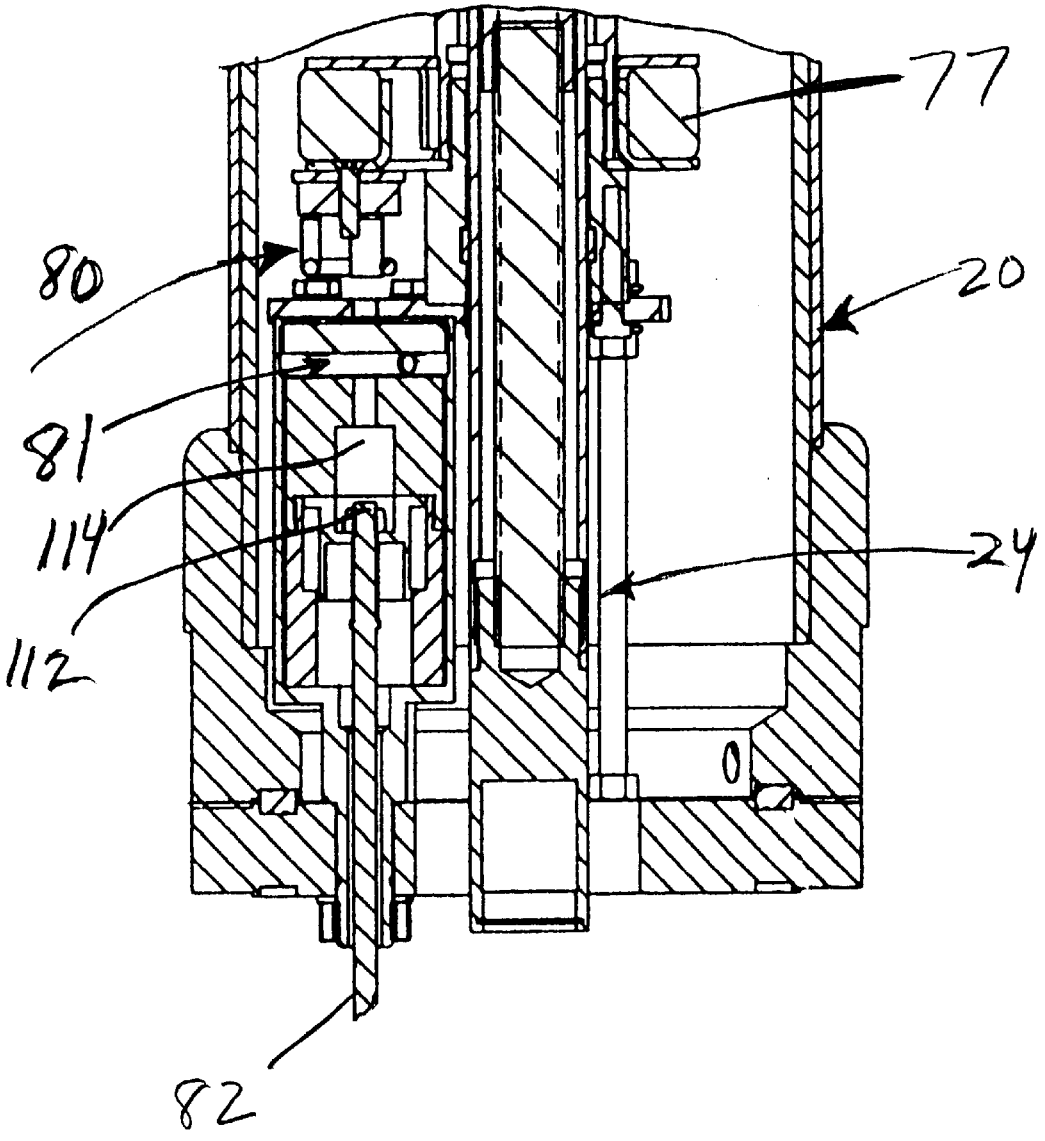
FIG. 7 is a partial sectional view of an interrupter of the protective device of FIGS. 3 and 4 illustrating a line-potential tripping arrangement thereof.

Considering additional aspects of the tripping arrangement 80 and referring additionally to FIG. 7, the insulated member 82 is connected at 112 to the output 114 of the magnetic latching solenoid 81. Along with the arrangement illustrated in FIG. 7, in lieu of the stored energy device 85 being located within the interrupter 20 adjacent the magnetic latching solenoid 81 of FIGS. 1 and 2, a driving spring 120 is provided about the insulated member 82 in the operating mechanism 10 as illustrated in FIG. 6. The driving spring 120 acts between the housing 22 of the operating mechanism 10 and a widened portion 122 of the insulated member 82. When the insulated member 82 is released by the magnetic latching solenoid 81, the driving spring 120 is arranged to drive the insulated member 120 downward in FIG. 6. A lower portion 82' of the insulated member 82 is affixed to an armature portion 124 of the signal generator 82 that moves within a magnetic core portion 126. The lower portion 82' of the insulated member 82 extends to the charging member 28 of the operating mechanism 10. During the charging operation to charge the operating mechanism 10 and close the interrupter 20, the charging member 28 drives the insulated member 82 via a resetting spring 128 that acts between the charging member and the insulated member 82.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. A protective device arrangement for an electrical power circuit comprising:

interrupting means for interrupting the electrical circuit path between first and second circuit terminals energized at a first potential;

operating means located at a second potential different than the electrical circuit path for operating said interrupting means;

control means being operative at the first potential of the electrical circuit path for sensing current flowing in the electrical circuit path and for generating a trip signal when predetermined overcurrent conditions are satisfied; and first means located within said interrupting means and extending to said operating means and responsive to said trip signal for rendering said operating means operative to operate said interrupting means.

2. The protective device arrangement of claim 1 wherein said first means comprises an operating member extending between said operating means and said control means.

3. The protective device arrangement of claim 2 wherein said first means further comprises generating means responsive to movement of said operating member to generate operating energy to operate said operating means.

4. A protective device arrangement for an electrical power circuit comprising:

interrupting means for interrupting the electrical circuit path between first and second circuit terminals energized at a first potential; and control means having at least portions thereof being operative at a second potential for generating operating energy in response to predetermined operating conditions for operating said interrupting means, said control means comprising an operating member extending from said second potential to said first potential and converting movement of said operating member to energy to operate said interrupting means.

5. A protective device arrangement for an electrical power circuit comprising:

interrupting means for interrupting the electrical circuit path between first and second circuit terminals energized at a first potential;

operating means located at a second potential different than the electrical circuit path for operating said interrupting means in response to a tripping input; and control means being operative at the first potential of the electrical circuit path for generating operating energy in response to predetermined operating conditions and for communicating said operating energy to said operating means, said control means comprising first means within said interrupting means for selectively storing and releasing energy, a movable member responsive to said first means for communicating movement to the vicinity of said operating means at said second potential, and second means responsive to said movable member for generating operating energy to provide a trip signal at said tripping input.

6. A protective device arrangement for an electrical power circuit comprising:

interrupting means for interrupting the electrical circuit path between first and second circuit terminals energized at a first potential;

operating means located at a second potential different than the electrical circuit path for operating said interrupting means in response to a tripping input; and control means being operative at the first potential of the electrical circuit path for generating operating energy in response to predetermined operating conditions and for communicating said operating energy to said operating means, said control means comprising first means within said interrupting means for selectively storing energy and releasing said stored energy and second means responsive to said releasing of said stored energy for converting said stored energy into an electrical trip signal at said tripping input.

* * * * *